United States Patent [19]

Körner

[11] Patent Number: 4,828,289

[45] Date of Patent: May 9, 1989

[54] BOOK

[76] Inventor: Lucy Körner, Bahnhofstrasse 49, D-7012 Fellbach, Fed. Rep. of Germany

[21] Appl. No.: 183,538

[22] Filed: Apr. 14, 1988

Related U.S. Application Data

[63] Continuation-in-part of Ser. No. 912,637, Sep. 26, 1986, abandoned.

[30] Foreign Application Priority Data

Sep. 27, 1985 [DE] Fed. Rep. of Germany ... 8527571[U]

[51] Int. Cl.[4] ..... B42D 1/00; B42D 3/08

[52] U.S. Cl. ..... 281/15.1; 281/36; 281/21.1; D19/28; D19/30

[58] Field of Search ..... 281/1, 15 R, 21 R, 36; 283/63; D19/26, 27, 28, 29, 30, 31, 32; 402/13

[56] References Cited

U.S. PATENT DOCUMENTS

| | | | |
|---|---|---|---|
| D. 37,976 | 5/1906 | Rhoads | D19/28 |
| D. 134,075 | 10/1942 | Tepel | D19/30 X |
| D. 142,669 | 10/1945 | Rogow | D19/28 |
| 399,249 | 3/1889 | Dobbins | 281/15 R |
| 447,622 | 3/1891 | Prahar | 281/15 R |
| 2,305,361 | 12/1942 | Tanner | 281/15 R X |
| 4,597,743 | 7/1986 | Becker et al. | 281/15 R X |

FOREIGN PATENT DOCUMENTS

| | | | |
|---|---|---|---|
| 1802230 | 8/1959 | Fed. Rep. of Germany . | |
| 1870428 | 10/1960 | Fed. Rep. of Germany . | |
| 3011065 | 10/1981 | Fed. Rep. of Germany | 281/15 R |
| 1087242 | 2/1955 | France . | |
| 1125262 | 10/1956 | France . | |
| 477296 | 10/1969 | Switzerland | D19/26 X |
| 16648 | of 1892 | United Kingdom | 281/15 R |
| 23379 | of 1914 | United Kingdom . | |
| 124938 | 4/1919 | United Kingdom | 402/13 |
| 768936 | 5/1955 | United Kingdom . | |

*Primary Examiner*—Paul A. Bell

*Attorney, Agent, or Firm*—Pretty, Schroeder, Brueggemann & Clark

[57] ABSTRACT

The invention relates to a book and is characterized in that the spine of the book has a shape different from a straight contour line, that fixing elements (3) for the cover (1) and the leaves (2) of the book are arranged inwardly of the edge (4) of the book, and that at least the front cover (1) is provided with a bending line (5) at the side of the fixing elements (3) opposite the edge (4) of the book. This makes it possible to give the book the shape of a children's toy (ball, doll, toy aniaml, car, or the like) projected on a plane.

8 Claims, 2 Drawing Sheets

BOOK

This application is a continuation-in-part of application Ser. No. 912,637, filed 9/26/86 abandoned.

The present invention relates to a book. Known books have a rectangular shape. There have also been known children's books of different shapes; however, their shape is always delimited by a straight contour line at least along the edge defining the spine of the book. This straight line forms at the same time the folding line about which the book can be opened. However, this straight line in the area of the spine of the book makes itself felt as an obstacle to the creative intentions of the designer if the book is to be given a fancy shape.

A book having a shape differing from the rectangular form has been known before from German Utility Patent No. 18 02 230. However, in the case of this book, the individual leaves are opened in a fan-like manner about a mounting screw serving as an axis. British Patent Specification No. 7 68 936 shows a book of partially circular shape, but the spine of the book is always straight, spoiling the shape.

Now, it is the object of the present invention to develop a book which while respecting the technical necessities regarding the book cover and the folding-over of the pages, does not substantially affect, or increases considerably, the aesthetic or artistic possibilities regarding the shape of the book.

According to the invention, this object is achieved by a design in which the spine of the book has a shape different from a straight contour line, in which fixing elements for the cover and the pages of the book are arranged inwardly of the edge of the book, and in which at least the front cover is provided with a straight bending line at the side of the fixing elements opposite the edge of the book. The invention provides the advantage that, serving no longer as a folding line, the spine of the book may have any desired shape so that when designing the book almost no regard must be given to the fact that the book necessarily has to fulfill the technical requirements regarding the opening and folding-over of the individual pages. It is true that books in the form of loose-leaf collections have been known where the fixing screws or pins are also arranged inwardly of the edge of the book and a straight folding line is provided in the cover at the side of the screws opposite the edge of the cover. However, the contour line of these books is always straight in the area of the screws, and parallel to the bending line in the cover, and these books always have a rectangular shape. In contrast, the contour line of the book according to the invention is not straight in the area of the spine, but may have any desired non-straight shape. The fixing elements provided for holding the block together and arranged at the side of the straight folding line opposite the spine of the book may consist of clips, rivets, or other fixing elements commonly used. In addition, the spine may be closed in the conventional manner, for example by means of a strip of cloth, or the like. This is possible because when opening the book or folding over the pages the block does not move in the area of the edge of the spine since this movement actually occurs only on the side of the bending fold opposite the fixing elements.

The book may, preferably, have the shape of a circular disk to form an eye-catcher. This shape is well suited not only for children's books, but also for advertising purposes and the like, and generally in all cases where the observer's attention is to be attracted by an unusual shape. It is, for example, possible to adapt the shape of the book to its contents. A children's book containing stories dealing with a ball may, for example, have a circular shape with the book cover showing the picture of a ball. Or else a children's book telling stories about deer may, for example, have the shape of a small deer.

Other features of the invention will become apparent from the following description of one embodiment of the invention when read in conjunction with the claims and the drawing, it being understood that the individual features may be implemented in any embodiment of the invention either individually or in any combination thereof.

Figure 1:
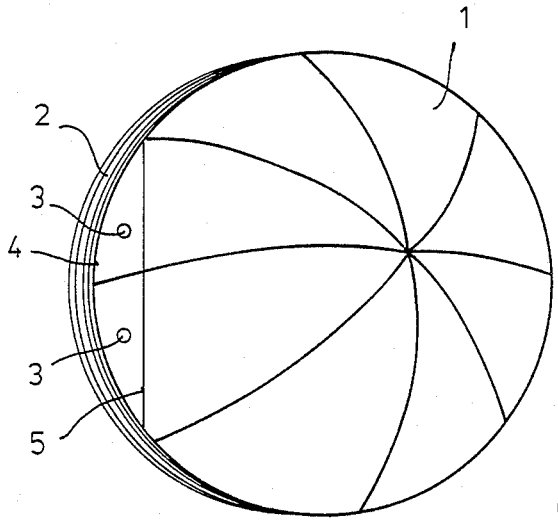
FIG. 1 shows the representation of a book of circular shape.

In the embodiment of the invention shown in FIG. 1, the book has the shape of a circular disk. It comprises a book cover 1 and a number of leaves 2 of which only the edges are visible in the perspective view of FIG. 1. The cover 1 carries the printed image of a ball with differently colored sectors. The cover 1 and the leaves 2 are held together by a rear book cover not shown in FIG. 1, and rivets 3 passing through the whole block. The contour 4 of the book does not follow a straight line in the area of the rivets 3, but rather the shape of a circular arc. At the side of the rivets 3 opposite the edge of the book, at least the cover 1 is provided with a straight folding line 5 forming the chord of the arc of a circle represented by the contour line of the book. When the book is opened, the cover 1 and the leaves are folded over about the folding line 5 or about corresponding bending lines extending in parallel to the folding line 5 below the cover, whereas the area of the block located on the side of the folding line 5 facing the rivets 3 remains firmly joined when the leaves are folded over. The spine of the book, which in this case has the shape of a cylinder segment, may be open or may be closed by a strip of cloth, or the like. The book may have a diameter of, say, 21 cm and a height of 6 mm and may contain 15 leaves with children's stories about the adventures of a ball printed thereon.

Figure 2:
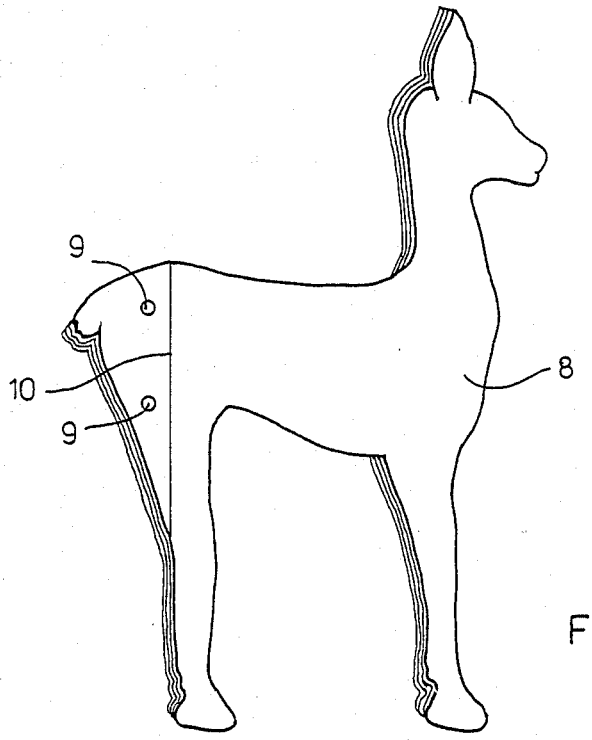
FIG. 2 shows a book having the shape of a deer projected upon the drawing plane.

In the case of the embodiment shown in FIG. 2, the book has the shape of a deer. Here, again, the front cover 8 of the book and the leaves arranged underneath, which all have the same shape, are held together by fixing elements 9 passing through the whole block. When the book is opened, the cover 8 and the leaves of the book are folded over about the folding line 10.

Figure 3:
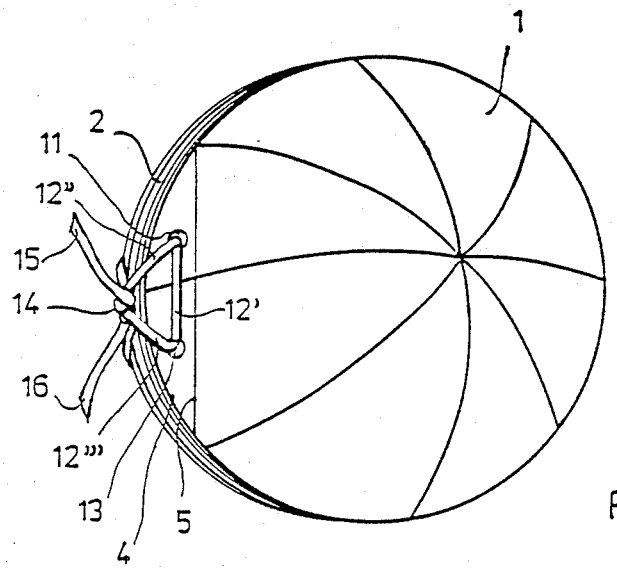
FIG. 3 shows the book represented in FIG. 1 with other fixing elements.
Figure 4:
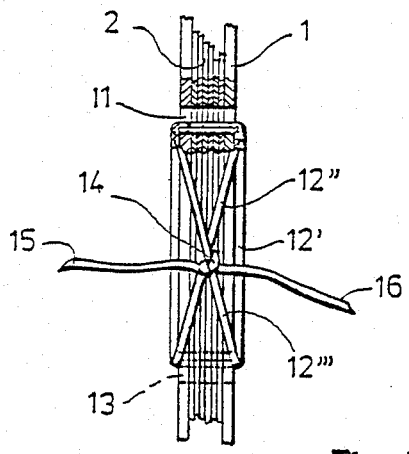
FIG. 4 shows a detail of the fixing elements of FIG. 3.

FIGS. 3 and 4 show the book described in FIG. 1 with other fixing elements for the leaves 2. The rivets 3 are replaced by a solid ribbon, for example a leather ribbon 12, penetrating the holes 11 and 13 and being knotted tightly. The ribbon 12 may pass twice through the holes so that two portions 12' of the ribbon are arranged on both the front cover and on the back cover of the book to connect the holes 11 and 13, the ribbon being knotted on the backside. The ribbon may also be fixed in the way as shown in the embodiment of the invention represented in FIGS. 3 and 4. Also here, the ribbon is passed twice through each of the holes 11 and 13, but the front cover and back cover of the book only show one of the portions 12' of the ribbon connecting the holes 11 and 13, another portion 12'' of the ribbon running from the hole 11 on the front cover of the book over the spine to the back cover and from there into the hole 13. Furthermore, another portion 12''' of the ribbon runs diagonally from the hole 13 to the outside edges of the leaves to form a knot 14 on the spine, to which a portion of the ribbon runs also from the hole 11 on the back cover. The ends 15 and 16 of the ribbon are knotted tightly in the knot 14. Since the ribbon runs also over the spine, it stabilizes the spine with respect to movements of individual leaves out of their position. In addition to the knot 14, the ends 15 and 16 of the ribbon may be formed into a nice loop. The colour of the ribbon 12 may be selected to fit the colour of the front cover so that such a book may look much more beautiful than a book provided with a spine held together only by rivets.

According to certain embodiments of the invention, rivets corresponding to the rivets 3 and 9, respectively, of the embodiment according to FIGS. 1 and 2 are provided in the holes 11 and 13. The ribbon 12 is passed through such rivets as shown in FIGS. 3 and 4. This arrangement serves to make the book look much more beautiful and to increase its sales value.

Figure 5:
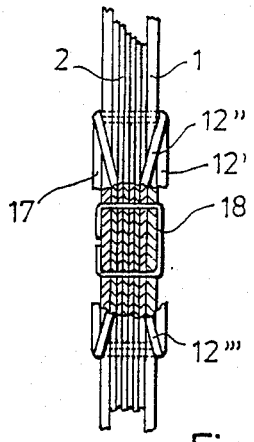
FIG. 5 shows a detail of another embodiment of the fixing elements.

The embodiment according to FIGS. 3 and 4 may be further improved by passing a staple 18 through the cover 1 and leaves 2 of the book, as shown in FIG. 5. Preferably, this staple 18 is located at a point where it is concealed by the ribbon portions 12' and the ribbon section 17 running across the bottom of the book opposite the ribbon portion 12' so that the staple 18 is not readily seen from the outside.

It goes without saying that the invention can be applied also to embodiments in which the book has the shape of another children's toy projected upon a plane, for example a doll, another toy animal, a car or the like. Or the book may have the shape of any other object projected upon a plane. In all cases, the spine of the book is not straight, but exhibits a shape different from a straight contour. Of course, the book may also have shapes which are not readily found in children's imagination, for example oval shapes or the like differing markedly from the rectangular shape usual for books.

I claim:

1. A book, comprising (a) a front cover;

(b) a back cover;

(c) a plurality of leaves between the front and back covers;

(d) a spine having a shape along an outer edge of the book different from a straight contour line and including a substantially straight bending line in the front cover located inwardly of the outer edge to enable the book to be opened and thereby expose the leaves;

(e) fixing means for securing the leaves in the book, comprising a top hole and a bottom hole spaced from each other and extending through the front cover, leaves and back cover in the region of the spine, and a ribbon having two free ends tied in a knot across the spine and being adapted to pass through the holes in such a manner that there is a first ribbon portion extending along the front cover from the bottom hole to the top hole, a second ribbon portion extending along the back cover from the bottom hole to the top hole, a third ribbon portion extending from the bottom hole across the front cover, spine and back cover to the top hole, and a fourth ribbon portion extending from the bottom hole across the back cover, spine and front cover to the top hole.

2. The book of claim 1, wherein the fixing means further comprises a staple passing through the front cover, leaves and back cover of the book in the region of the spine between the top and bottom holes, with the staple being concealed by the first and second ribbon portion.

3. The book of claim 1, wherein the fixing means further comprises hollow rivets in the top hole and bottom hole, with the ribbon passing through the hollow portion of the rivets.

4. The book of claim 1, wherein the free ends of the ribbon are tied in the form of a knot with two loops.

5. The book of claim 1, wherein the ribbon is made of leather.

6. The book of claim 1, wherein the book has the shape of a circular disk.

7. The book of claim 1, wherein the book has the shape of a children's toy.

8. The book of claim 7, wherein the children's toy has the shape of a ball, doll, animal or car.

* * * * *